United States Patent [19]

Holmgren et al.

[11] 4,302,365

[45] Nov. 24, 1981

[54] ENGINE DEGREASER COMPOSITION

[75] Inventors: William C. Holmgren; Charles E. Hiddema, both of Muskegon, Mich.

[73] Assignee: American Grease Stick Company, Muskegon, Mich.

[21] Appl. No.: 120,290

[22] Filed: Feb. 11, 1980

[51] Int. Cl.[3] ..... C11D 3/44; C11D 7/52

[52] U.S. Cl. ..... 252/548; 252/153; 252/550; 252/170; 252/171; 252/173

[58] Field of Search ..... 252/122, 153, 170, 162, 252/171, 172, 173, 90, 548, 550; 134/40

[56] References Cited

U.S. PATENT DOCUMENTS

| | | | |
|---|---|---|---|
| Re. 29,649 | 5/1978 | Farnsworth | 252/171 |
| 1,822,957 | 9/1931 | Dobmaier | 252/356 |
| 2,036,848 | 4/1936 | Amthor et al. | 252/162 |
| 2,338,522 | 1/1944 | Liberthson | 252/33 |
| 2,408,155 | 9/1946 | Thornberry | 148/8 |
| 2,466,632 | 4/1949 | Borus | 252/118 |
| 2,509,197 | 5/1950 | Borus | 252/118 |
| 2,671,036 | 3/1954 | Obermeit | 134/20 |
| 2,748,084 | 5/1956 | de Lew et al. | 252/172 |
| 2,901,433 | 8/1959 | Spring | 252/118 |
| 2,929,789 | 3/1960 | Pickett et al. | 252/153 |
| 2,952,637 | 9/1960 | Bray et al. | 252/118 |
| 3,057,804 | 10/1962 | Berkeley et al. | 252/118 |
| 3,078,189 | 2/1963 | Baker | 134/26 |
| 3,131,154 | 4/1964 | Klausner | 252/305 |
| 3,167,514 | 1/1965 | Baker | 252/170 |
| 3,248,335 | 4/1966 | Teot et al. | 252/559 |
| 3,252,915 | 5/1966 | Jeffrey | 252/171 |
| 3,277,013 | 10/1966 | Gianladis | 252/153 |
| 3,535,160 | 10/1970 | Arger | 134/22 |
| 3,607,769 | 9/1971 | McIntyre | 252/104 |
| 3,717,590 | 2/1973 | Fetty | 252/540 |
| 3,723,330 | 2/1973 | Sheflin | 252/153 |
| 3,822,213 | 7/1974 | Johnson | 252/162 |
| 3,835,070 | 9/1974 | Beck | 252/526 |
| 3,856,695 | 12/1974 | Geiss et al. | 252/162 |
| 3,915,902 | 10/1975 | Ancel et al. | 252/526 |
| 3,983,047 | 9/1976 | Vinson | 252/119 |
| 3,989,640 | 11/1976 | Culver et al. | 252/364 |

FOREIGN PATENT DOCUMENTS

| | | |
|---|---|---|
| 1145892 | 3/1963 | Fed. Rep. of Germany . |
| 2390484 | 1/1979 | France . |
| 1553194 | 9/1979 | United Kingdom . |
| 309040 | 9/1971 | U.S.S.R. . |
| 547647 | 5/1977 | U.S.S.R. . |

OTHER PUBLICATIONS

Bennett, H., "The Chemical Formulary", vol. XIV, The Chemical Publishing Co., N. Y., 1968, pp. 175, 177.

*Primary Examiner*—P. E. Willis, Jr.
*Attorney, Agent, or Firm*—Miller, Morriss & Pappas

[57] ABSTRACT

A foam type engine degreaser composition consisting of an opaque, viscous emulsion having a high water content. A controlled amount of water is added to middle distillate degreasers such as kerosene, naptha, fuel oil and/or heavy naptha so as to form an emulsion which thickens the solvent and causes foaming.

1 Claim, No Drawings

ENGINE DEGREASER COMPOSITION

The present invention relates to an engine degreaser composition for externally cleaning automotive engines and more particularly with respect to a foam type engine degreaser composition consisting of an opaque viscous emulsion that utilizes a significant portion of water in place of more expensive petrochemical solvents previously used.

A problem that has always existed in the automotive field is that automobile engines accumulate dirt, oil and grease. Such accumulations tend to prevent heat transfer and thus contribute to warmer running engines, which in turn decreases fuel-efficiency and increases the use of oil. This is undesirable in this time of the energy crisis which is facing our nation.

Another obvious problem is that such accumulations of dirt, oil and grease cause mechanics and "do-it-yourself" car owners to stain their clothing when working on such engines.

Various preparations and techniques have been used over the years to clean such engines without the need of removing the engine from the vehicle and submerging it in solvent. For example, steam cleaning, hose flushing, physical scraping, and application of various liquids have all been utilized in the process of degreasing or cleaning automobile engines.

One of the key problems in cleaning automobile engines in situ with known chemical solvent preparations has been that the solvents used drip or run-off quickly before the dirt, oil and grease accumulations can be satisfactorily emulsified. The thin, runny nature of such middle and upper distillations as kerosine or naphtha make them particularly less effective on the vertical and undersides of the engine, although such solvents perform well when the engine is removed and submerged in such solvents.

The external engine cleaning compositions of the known prior art also are generally clear liquids and hence, once applied, they are not easily visible against the engine that is being cleaned. Thus, difficulty is encountered in evenly applying the cleaning composition to the engine. For this reason, excessive amounts of cleaning compositions are used in making unnecessary re-applications. Further, such known prior art external engine cleaning compositions contain hydrocarbon solvents (primarily middle range distillates such as kerosine, fuel oil and naphtha) but no water. In each instance, such prior art compositions are sprayed on the automotive engine (by squeeze bottle, aerosol pack, or by pump delivery). Before the solvent mixture runs off the engine, it is sprayed or flushed with water which forms an emulsion with the solvent to give better cleaning action. Thus, not only are the external engine cleaning compositions of the prior art comprised mainly of expensive conventional kerosine, fuel oil or naphtha fractions, but an additional water flushing step is required to achieve the desired cleaning of the engine.

It is therefore an object of this invention to provide an engine degreaser composition for use with an aerosol package which consists of an oil and water emulsion.

Another object of this invention is to provide an engine degreaser composition which contains between 20% to 85% water in addition to petrochemical solvents normally used in external engine cleaners of the prior known art and hence, is more economical to produce.

Another object of this invention is to provide an engine degreaser composition which has a thicker consistency and/or clinging foam characteristic not found in the external engine cleaners of the prior known art and for these reasons can remain for long periods on all vertical and horizontal surfaces (including the underside) of the engine being cleaned, thus enhancing its cleaning effectiveness.

Yet another object of this invention is to provide an engine degreaser composition which is opaque instead of clear, thus enabling the user to easily monitor the areas of the engine to which the cleaner has been applied.

A still further object of this invention is to provide an engine degreaser composition that forms a foaming cleaner when applied externally to an engine and does not require the addition of water to enhance its cleaning action.

Another object of this invention is to provide an engine degreaser composition with a controllable emulsifying capacity and/or viscosity.

Other objects of the present invention will be apparent to those skilled in this field as the description proceeds.

The present invention is an engine degreaser and cleaner composition in which a controlled amount of water is added to middle distillate degreasers such as kerosine, naphtha, fuel oil and/or heavy naphtha so as to form an emulsion which thickens the solvents and causes foaming. When applied to an engine, the foaming action keeps the composition in contact with grease deposits for a longer period of time, thus providing more effective cleaning action than previously known engine degreasers which splash and immediately run off.

Further, the addition of water to the middle distillate solvents produces an engine degreaser emulsion consisting of a foamy opaque milk white liquid rather than the clear liquids of the engine degreasers of the prior known art. Thus, the opaque engine degreaser of the instant invention makes it easier to monitor during application and hence results in savings due to ease and quickness of application and the reduction of wasted product due to inadvertent double applications.

The present invention also results in substantial economic savings due to the fact that water is substituted for more expensive petrochemical solvents that have previously been used in the engine degreasers of the prior art which are comprised solely of various types of petrochemical solvents. The use of water in the engine degreaser of the instant invention also results in an overall reduction in the use of petrochemicals in keeping with fuel saving objectives brought about by the current energy crisis.

The engine degreaser composition of the present invention can be applied from a can or bottle. Aerosol cans are particularly effective in contributing to a heavy foam coating. However, it is within the scope of the invention that other forms of dispensers be used, including push-button spray dispensers. Containers provided with a special aerosol valve that sprays right-side up or upside down are especially helpful for reaching the vertical sides and lower portion of the engine and avoiding loss of propellant.

The following range of formulations are typical of the types of formulations which comprise the engine degreaser composition of the present invention. The composition can involve 20% to 80% kerosine, fuel oil and/or heavy naphtha, 20% to 85% water (balance), 2% to 15% surfactant, 5% to 15% of 1, 1, 1 trichloroethane, 5% to 15% butyl cellosolve and about 10% aromatic solvent. However, it was found that a composition of water and middle distillate did not release enough solvent. The addition of a co-solvent, such as butyl cellosolve, effectively destabilized the emulsion so that the middle distillates are released in a controlled manner. Thus, the emulsification rate of the product with the degreaser can be controlled by adjusting the solvent system and the amount of co-solvent (e.g. mono and dialkyl ethers of alkylene glycols).

The emulsification rate of the product can be adjusted to suit a particular application by varying the water content and/or surfactants used. The consistency can be varied from water-like to a thick paste.

The following example illustrates the general composition ranges of the present invention based on the weight of the whole composition:

| | |
|---|---|
| Organic co-solvents (esters, ethers, ketones, alcohols, etc.) | 0%–15% |
| Halogenated organic solvents | 0%–50% |
| Aliphatic solvents | 0%–45% |
| Aromatic solvents | 0%–20% |
| Emulsifiers | 2%–12% (type and quantity determined by solvent system) |
| Water | Balance |

There are two specific approaches within the scope of the above composition. One approach is an oil and water emulsion that becomes thickened such as:

| | |
|---|---|
| Fuel oil | 37% |
| 1,1,1 Trichloroethane | 12% |
| Butyl cellosove (monobutyl ether of ethylene glycol) | 8% |
| Emulsifier | 6% |
| Water | 37% |
| Aerosol package using nitrous oxide propellant or pump spray. | |

Another approach is to make a foam by using suitable surfactants/emulsifiers and solvent. This formulation relies on expulsion through an aerosol propellant* system. An example of this is:

| | |
|---|---|
| Sodium lauryl sulfate | 3% |
| Triethanolamine | 1% |
| Xylene | 13% |
| Butylcellosolve | 1% |
| Water | 82% |

*Aerosol package using hydrocarbon propellant

Testing of the engine degreaser composition of the present invention has shown a more effective engine cleaner than the engine degreaser compositions of the prior known art. The incorporation of a significant portion of water into the composition has imparted a foaming characteristic to the composition which enables it to cling to the engine surfaces, thus greatly enhancing the cleaning action. The addition of water also imparts a milky opaque quality to the liquid composition which enables the user to more easily monitor and control the application of the engine degreaser composition to the engine surfaces. The use of water to form an emulsion with the middle distillate solvents results in great cost savings and decreases the overall amounts of petrochemicals.

Other modifications can be made in the compositions and methods of the present invention without departing from the spirit or the scope thereof and it is to be understood that such modifications are included within the scope of the appended claims.

We claim:

1. An engine degreaser composition for use in an aerosol package comprising a mixture of:

| | Percent by Weight |
|---|---|
| Sodium lauryl sulfate | 3 |
| Triethanolamine | 1 |
| Xylene | 13 |
| Butyl cellosolve | 1 |
| Water | 82 |

* * * * *